US009535356B2

(12) United States Patent
Otani et al.

(10) Patent No.: US 9,535,356 B2
(45) Date of Patent: Jan. 3, 2017

(54) IMAGE FORMING APPARATUS HAVING A FUNCTION TO APPLY CHARGE REMOVAL LIGHT TO PHOTOSENSITIVE MEMBER

(71) Applicant: KYOCERA Document Solutions Inc., Osaka-shi, Osaka (JP)

(72) Inventors: Shinji Otani, Osaka (JP); Norio Kubo, Osaka (JP); Masashi Fujishima, Osaka (JP); Koji Suenami, Osaka (JP); Yoshimi Shimizu, Osaka (JP); Kenichi Tamaki, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/960,068

(22) Filed: Dec. 4, 2015

(65) Prior Publication Data

US 2016/0161879 A1 Jun. 9, 2016

(30) Foreign Application Priority Data

Dec. 8, 2014 (JP) ..... 2014-247557
Dec. 8, 2014 (JP) ..... 2014-247558
Dec. 8, 2014 (JP) ..... 2014-247559

(51) Int. Cl.

| | |
|---|---|
| ***G03G 21/00*** | (2006.01) |
| ***G03G 15/02*** | (2006.01) |
| ***G03G 15/09*** | (2006.01) |
| ***G03G 15/16*** | (2006.01) |
| ***G03G 21/08*** | (2006.01) |

(52) U.S. Cl.

CPC ..... *G03G 15/0275* (2013.01); *G03G 15/09* (2013.01); *G03G 15/169* (2013.01); *G03G 21/08* (2013.01)

(58) Field of Classification Search

USPC ..... 399/9, 31, 127, 128, 252, 265–267, 296
See application file for complete search history.

(56) References Cited

U.S. PATENT DOCUMENTS

| | | | | |
|---|---|---|---|---|
| 4,897,333 | A | 1/1990 | Matsushita | |
| 5,983,041 | A | 11/1999 | Otaki et al. | |
| 7,155,152 | B2 * | 12/2006 | Iwai | G03G 15/1645 399/128 |
| 2004/0126148 | A1 | 7/2004 | Iwai et al. | |
| 2013/0195488 | A1 | 8/2013 | Hatano | |

FOREIGN PATENT DOCUMENTS

| | | | |
|---|---|---|---|
| JP | 64013578 | A | 1/1989 |

OTHER PUBLICATIONS

European Patent Office, Partial European Search Report Issued in Application No. 151959863, Apr. 19, 2016, Germany, 7 pages.

* cited by examiner

*Primary Examiner* — Hoan Tran
(74) *Attorney, Agent, or Firm* — Alleman Hall McCoy Russell & Tuttle LLP

(57) ABSTRACT

In the case where development is performed by a two-component developing method, a previous charge removal light-emitting portion applies charge removal light to a first charge removal target region of an effective outer circumferential surface of a photosensitive member on which effective outer circumferential surface an electrostatic latent image can be formed. The first charge removal target region includes a part of a magnetic brush contact region of the effective outer circumferential surface and a region of the effective outer circumferential surface between the magnetic brush contact region and a transfer position of a toner image.

12 Claims, 6 Drawing Sheets

IMAGE FORMING APPARATUS HAVING A FUNCTION TO APPLY CHARGE REMOVAL LIGHT TO PHOTOSENSITIVE MEMBER

INCORPORATION BY REFERENCE

This application is based upon and claims the benefit of priority from the corresponding Japanese Patent Application No. 2014-0247558 filed on Dec. 8, 2014, and No. 2014-247557 filed on Dec. 8, 2014, and No. 2014-247559 filed on Dec. 8, 2014, the entire contents of which are incorporated herein by reference.

BACKGROUND

The present disclosure relates to an electrophotographic type image forming apparatus.

In an electrophotographic type image forming apparatus, a two-component developing method has been known. In the two-component developing method, a developing roller which carries a magnetic brush including toner and a carrier brings the magnetic brush into contact with the outer circumferential surface of a rotating photosensitive member, thereby developing an electrostatic latent image on the outer circumferential surface of the photosensitive member into a toner image.

Meanwhile, it has been known that, in the image forming apparatus, charge removal prior to transfer is performed in order to improve transferability of the toner image from the photosensitive member to a to-be-transferred medium such as a paper sheet or a belt member. The charge removal prior to transfer is to apply charge removal light to a region of the outer circumferential surface of the photosensitive member between a development position and a transfer position of the toner image.

SUMMARY

An image forming apparatus according to one aspect of the present disclosure includes a developing portion and a previous charge removal light-emitting portion. The developing portion is configured to carry a magnetic brush including toner and a carrier and bring the magnetic brush into contact with an effective outer circumferential surface of an outer circumferential surface of a rotating photosensitive member on which effective outer circumferential surface an electrostatic latent image can be formed, thereby to develop the electrostatic latent image into a toner image. The previous charge removal light-emitting portion is a light-emitting portion configured to apply charge removal light to a charge removal target region of the effective outer circumferential surface of the photosensitive member.

An image forming apparatus according to another aspect of the present disclosure includes a developing rotator, a collecting rotator, and a previous charge removal light-emitting portion. The developing rotator is a rotator configured to rotate while carrying a magnetic brush including toner and a carrier. The developing rotator is configured to carry the magnetic brush including the toner and the carrier and bring the magnetic brush into contact with an effective outer circumferential surface of an outer circumferential surface of a rotating photosensitive member on which effective outer circumferential surface an electrostatic latent image can be formed, thereby to develop the electrostatic latent image into a toner image. The collecting rotator is a rotator configured to rotate so as to be opposed to a portion of the effective outer circumferential surface of the photosensitive member between a magnetic brush contact region and a transfer position of the toner image. The magnetic brush contact region is a region with which the magnetic brush is brought into contact. The collecting rotator is configured to collect the carrier on the effective outer circumferential surface of the photosensitive member. The previous charge removal light-emitting portion is a light-emitting portion configured to apply charge removal light to a charge removal target region of the effective outer circumferential surface of the photosensitive member from a position at a downstream side in a rotation direction of the photosensitive member with respect to a position of the collecting rotator. The charge removal target region includes a part of the magnetic brush contact region of the effective outer circumferential surface of the photosensitive member and a region of the effective outer circumferential surface between the magnetic brush contact region and the transfer position.

An image forming apparatus according to still another aspect of the present disclosure includes the developing rotator, a collecting rotator having an outer circumferential surface formed in a black-based color, and the previous charge removal light-emitting portion. The collecting rotator having the outer circumferential surface formed in the black-based color is configured to rotate so as to be opposed to a portion of the effective outer circumferential surface of the photosensitive member between the magnetic brush contact region and the transfer position, to collect the carrier on the effective outer circumferential surface of the photosensitive member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the accompanying drawings. The following embodiments are examples embodying the present disclosure and do not have nature of limiting the technical scope of the present disclosure.

[First Embodiment: Schematic Configuration of Image Forming Apparatus]

Figure 1:
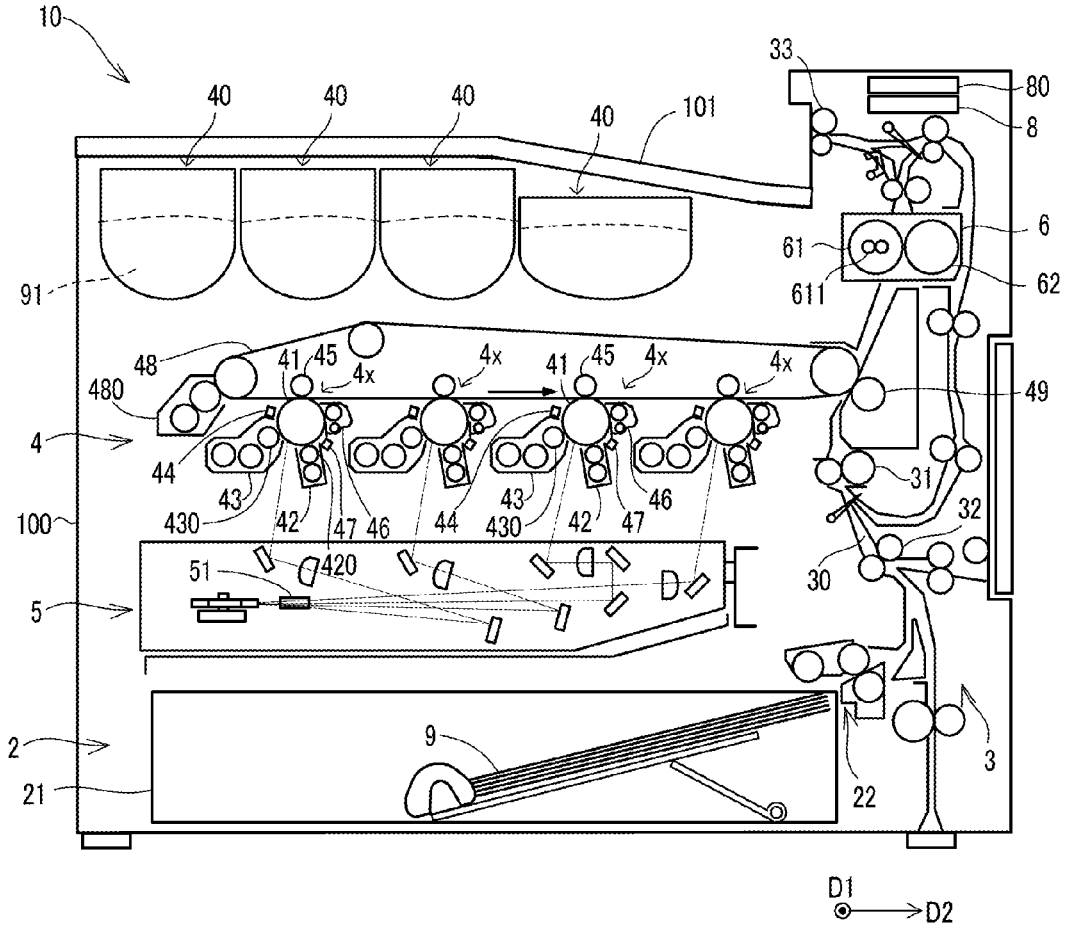
FIG. 1 is a configuration diagram of an image forming apparatus according to a first embodiment of the present disclosure.

First, a schematic configuration of an image forming apparatus 10 according to a first embodiment of the present disclosure will be described with reference to FIGS. 1 and 2. The image forming apparatus 10 is an electrophotographic type image forming apparatus. As shown in FIG. 1, the image forming apparatus 10 includes, within a housing 100, a sheet feed portion 2, a sheet conveying portion 3, toner supply portions 40, an image forming portion 4, an optical scanning portion 5, a fixing portion 6, a control portion 8, and an operation display portion 80, etc.

The image forming apparatus 10 is, for example, a printer, a copy machine, a facsimile, a multifunction peripheral, or the like. The multifunction peripheral has the function of the printer, and the function of the copy machine, etc.

The image forming apparatus 10 shown in FIG. 1 is a tandem-type image forming apparatus, and is a color printer. Thus, the image forming portion 4 further includes an intermediate transfer belt 48, a secondary cleaning portion 480, and a secondary transfer portion 49.

The image forming portion 4 also includes a plurality of single-color image forming portions 4*x* corresponding to colors of cyan, magenta, yellow, and black, respectively. The image forming apparatus 10 further includes a plurality of the toner supply portions 40 which supply cyan toner 91, magenta tonner 91, yellow tonner 91, and black tonner 91 to respective developing portions 43 described later.

The sheet feed portion 2 includes a sheet receiving portion 21 and a sheet sending-out portion 22. The sheet receiving portion 21 is configured to allow a plurality of recording sheets 9 to be placed in a stacked manner thereon. The recording sheets 9 are sheet-like media on which an image is to be formed, such as paper, coated paper, postcards, envelopes, OHP sheets, and the like.

The sheet sending-out portion 22 rotates in contact with the recording sheet 9 to send out the recording sheet 9 from the sheet receiving portion 21 toward a conveyance path 30.

The sheet conveying portion 3 includes registration rollers 31, conveying rollers 32, and discharge rollers 33, etc. The registration rollers 31 and the conveying rollers 32 convey the recording sheet 9 fed from the sheet feed portion 2, toward the secondary transfer portion 49 of the image forming portion 4. Furthermore, the discharge rollers 33 discharge the recording sheet 9 on which an image has been formed, through a discharge port of the conveyance path 30 onto a discharge tray 101.

[Image Forming Portion]

Each single-color image forming portion 4*x* includes a drum-shaped photosensitive member 41, a charging portion 42, the developing portion 43, a previous charge removal light-emitting portion 44, a primary transfer portion 45, a primary cleaning portion 46, and a subsequent charge removal light-emitting portion 47, etc. The photosensitive member 41 is a member on which an electrostatic latent image is written with laser light, and is an example of a toner image carrier which carries a toner image while rotating. For example, each photosensitive member 41 may be an organic photosensitive member or an amorphous silicon photosensitive member.

Hereinafter, a region of the outer circumferential surface of the photosensitive member 41 on which region the electrostatic latent image can be formed, that is, a region of the outer circumferential surface of the photosensitive member 41 which region has a maximum width and on which region an image can be formed, is referred to as effective outer circumferential surface 410. A first direction D1 shown in FIGS. 1 to 3 is a width direction of the photosensitive member 41, that is, a horizontal direction along a rotation center of the photosensitive member 41. A second direction D2 shown in FIGS. 1 to 3 is a direction orthogonal to the first direction D1 in the horizontal plane.

The photosensitive member 41 rotates, and the charging portion 42 uniformly charges the effective outer circumferential surface 410 of the photosensitive member 41. Furthermore, the optical scanning portion 5 including a laser light source 51 performs scanning with laser light, thereby writing an electrostatic latent image onto the charged effective outer circumferential surface 410 of the photosensitive member 41. Moreover, the developing portion 43 supplies the toner 91 to the photosensitive member 41, thereby developing the electrostatic latent image into the toner image.

The primary transfer portion 45 transfers the toner image on the effective outer circumferential surface 410 of the photosensitive member 41, onto the intermediate transfer belt 48. The primary cleaning portion 46 removes the toner 91 remaining on the outer circumferential surface of the photosensitive member 41. In the present embodiment, the intermediate transfer belt 48 is an example of a to-be-transferred medium onto which the toner image is transferred from the photosensitive member 41.

The intermediate transfer belt 48 is an endless belt-like member formed in a loop shape. The intermediate transfer belt 48 rotates in a state of being extended on and between two rollers. In the image forming portion 4, each single-color image forming portion 4*x* forms the toner image of the color thereof on the surface of the intermediate transfer belt 48. Thus, a color image in which the toner images of the respective colors are superposed is formed on the intermediate transfer belt 48.

The secondary transfer portion 49 transfers the toner image formed on the intermediate transfer belt 48, onto the recording sheet 9. The secondary cleaning device 480 removes the toner 91 remaining on a portion of the intermediate transfer belt 48 which portion has passed through the secondary transfer portion 49.

The fixing portion 6 sends out the recording sheet 9 on which the image has been formed, while sandwiching the recording sheet 9 between a heating roller 61 housing a heater 611 and a pressure roller 62. By so doing, the fixing portion 6 heats the image on the recording sheet 9 to fix the image on the recording sheet 9.

The developing portion 43 in the present embodiment performs development by a two-component developing method. That is, the developing portion 43 agitates a two-component developer 90 including the toner 91 and a carrier 92, to charge the toner 91, and supplies the charged toner 91 to the photosensitive member 41.

The carrier 92 is a magnetic granular substance. For example, the carrier 92 may be a granular material which includes a granular magnetic material and a synthetic resin film coating the surface of the magnetic material, such as epoxy resin.

Figure 2:
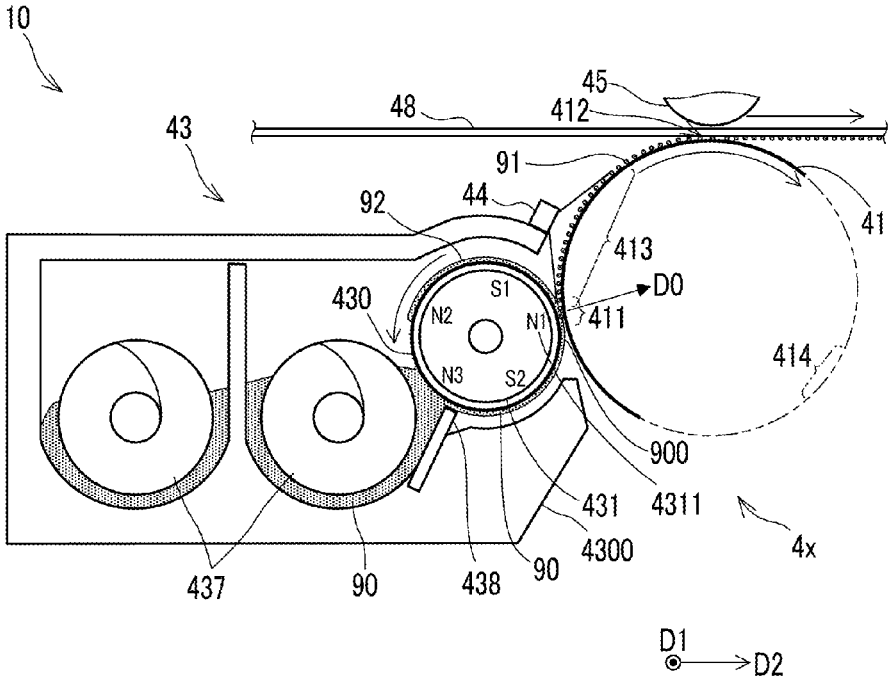
FIG. 2 is a configuration diagram of a previous charge removal light-emitting portion and a peripheral region thereof in the image forming apparatus according to the first embodiment of the present disclosure, as seen along a first direction.
Figure 3:
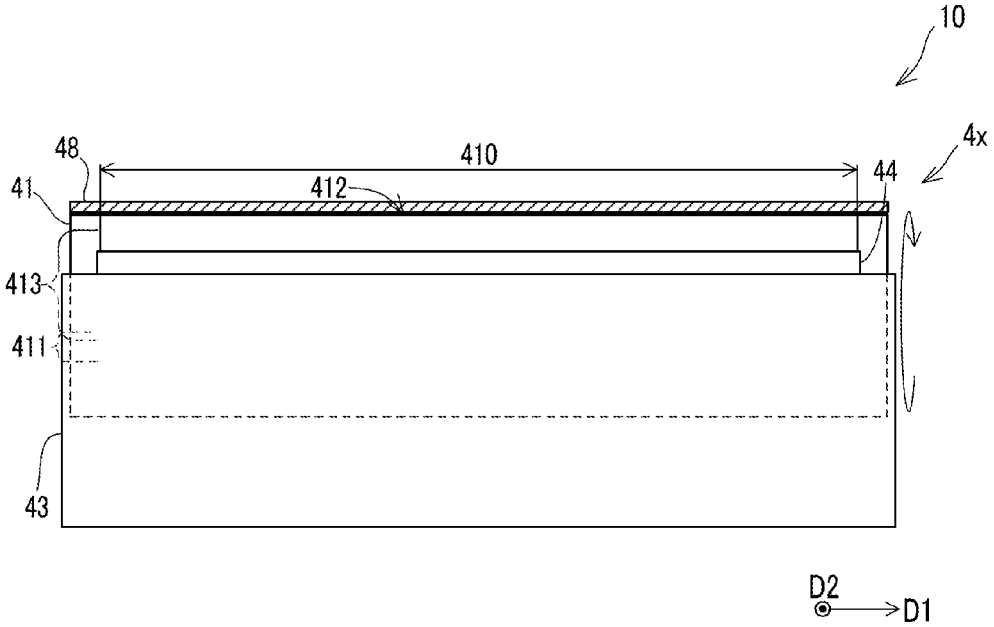
FIG. 3 is a configuration diagram of the previous charge removal light-emitting portion and the peripheral region thereof in the image forming apparatus according to the first embodiment of the present disclosure, as seen along a second direction.

As shown in FIG. 2, the developing portion 43 includes a developer tank 4300, a developing roller 430, agitating members 437, and a blade 438. The developing portion 43 further includes a magnet 431 for development. The magnet 431 is housed in the developing roller 430. The developing roller 430 and the magnet 431 form a magnet roller for carrying the two-component developer.

The developer tank 4300 is a container which contains the two-component developer 90. The developing roller 430 and the agitating members 437 rotate within the developer tank 4300. The developing roller 430 is rotatably supported so as to be opposed to the photosensitive member 41 in a non-contact state.

During a development operation, the developing roller 430 rotates in a direction opposite to the rotation direction of the photosensitive member 41. Thus, portions of the outer circumferential surfaces of the developing roller 430 and the photosensitive member 41 which portions are opposed to each other move in the same direction.

The agitating members 437 agitate the two-component developer 90 within the developer tank 4300. Thus, the toner 91 is charged with predetermined polarity. In addition, the carrier 92 is charged with polarity opposite to the charged polarity of the toner 91.

The developing roller 430 is an example of a two-component developer carrier which rotates while carrying the agitated two-component developer 90. The developing roller 430 supplies the charged toner 91 of the carried two-component developer 90, to the photosensitive member 41.

Specifically, the developing roller 430 carries the two-component developer 90 as a magnetic brush 900 by action of a magnetic force of the housed magnet 431, and conveys the magnetic brush 900 to a position opposed to the rotating photosensitive member 41.

Furthermore, the developing roller 430 brings the magnetic brush 900 into contact with the effective outer circumferential surface 410 of the rotating photosensitive member 41, thereby developing the electrostatic latent image into the toner image. Hereinafter, a region of the effective outer circumferential surface 410 of the photosensitive member 41 with which region the magnetic brush 900 is brought into contact is referred to as a magnetic brush contact region 411.

The toner 91 in the magnetic brush 900 shifts from the surface of the developing roller 430 to a portion of the effective outer circumferential surface 410 of the photosensitive member 41 on which portion the electrostatic latent image has been formed, by action of a developing bias applied to the developing roller 430. Thus, the electrostatic latent image is developed as the toner image.

The blade 438 limits the thickness of the magnetic brush 900 at a halfway position before the magnetic brush 900 carried on the outer circumferential surface of the developing roller 430 reaches the magnetic brush contact region 411.

The potential difference between the outer circumferential surface of the developing roller 430 and the portion of the effective outer circumferential surface 410 of the photosensitive member 41 on which portion the electrostatic latent image has been formed has the same polarity as the charged polarity of the toner 91. In addition, the potential difference between the outer circumferential surface of the developing roller 430 and the other portion of the effective outer circumferential surface 410 of the photosensitive member 41 on which the electrostatic latent image has not been formed has polarity opposite to the charged polarity of the toner 91. Thus, the charged toner 91 in the magnetic brush 900 selectively adheres to the portion of the magnetic brush contact region 411 of the photosensitive member 41 on which portion the electrostatic latent image has been formed.

Meanwhile, the carrier 92 in the magnetic brush 900 is held on the developing roller 430 by attraction of the magnet 431 even after passing through the magnetic brush contact region 411.

[Charge Removal Light-Emitting Portion]

The previous charge removal light-emitting portion 44 is a light-emitting portion which applies charge removal light to a first charge removal target region 413 of the effective outer circumferential surface 410 of the photosensitive member 41 at the upstream side in the rotation direction of the photosensitive member 41 with respect to a transfer position 412. The transfer position 412 is a position opposed to the primary transfer portion 45, and is a position at the downstream side in the rotation direction of the photosensitive member 41 with respect to a position opposed to the developing portion 43.

The subsequent charge removal light-emitting portion 47 is a light-emitting portion which applies charge removal light to a second charge removal target region 414 of the effective outer circumferential surface 410 of the photosensitive member 41 at the downstream side in the rotation direction of the photosensitive member 41 with respect to the transfer position 412. The second charge removal target region 414 is a region between the transfer position 412 and a charging position. The charging position is a position opposed to the charging portion 42, and is a position at the downstream side in the rotation direction of the photosensitive member 41 with respect to the transfer position 412.

Each of the previous charge removal light-emitting portion 44 and the subsequent charge removal light-emitting portion 47 is, for example, an LED array or the like formed so as to extend along the first direction D1. Each of the previous charge removal light-emitting portion 44 and the subsequent charge removal light-emitting portion 47 outputs the charge removal light having a wavelength which is predetermined according to the photosensitive characteristics of the photosensitive member 41.

In the example shown in FIG. 1, each subsequent charge removal light-emitting portion 47 applies the charge removal light to a region of the effective outer circumferential surface 410 of the photosensitive member 41 between a cleaning position opposed to the primary cleaning portion 46 and the charging position. The subsequent charge removal light-emitting portion 47 may apply the charge removal light to a region of the effective outer circumferential surface 410 of the photosensitive member 41 between the transfer position and the cleaning position.

By the charge removal light being applied from the previous charge removal light-emitting portion 44 to the first charge removal target region 413 of the effective outer circumferential surface 410 of the photosensitive member 41, the transferability of the toner image from the photosensitive member 41 at the charging position to the intermediate transfer belt 48 improves.

By the charge removal light being applied from the subsequent charge removal light-emitting portion 47 to the second charge removal target region 414 of the effective outer circumferential surface 410 of the photosensitive member 41, variations of the potential on the effective outer circumferential surface 410 of the photosensitive member 41 are eliminated. As a result, the effective outer circumferential surface 410 of the photosensitive member 41 enters a more uniformly charged state through a charging step by the charging portion 42.

The control portion 8 controls various electronic devices included in the image forming apparatus 10, on the basis of input information inputted through the operation display portion 80 and detection results of various sensors. In addition, the control portion 8 causes an operation menu and the like to be displayed on the operation display portion 80. Furthermore, the control portion 8 receives an image formation job from a host apparatus and executes an image process for an image of the image formation job.

Figure 4:
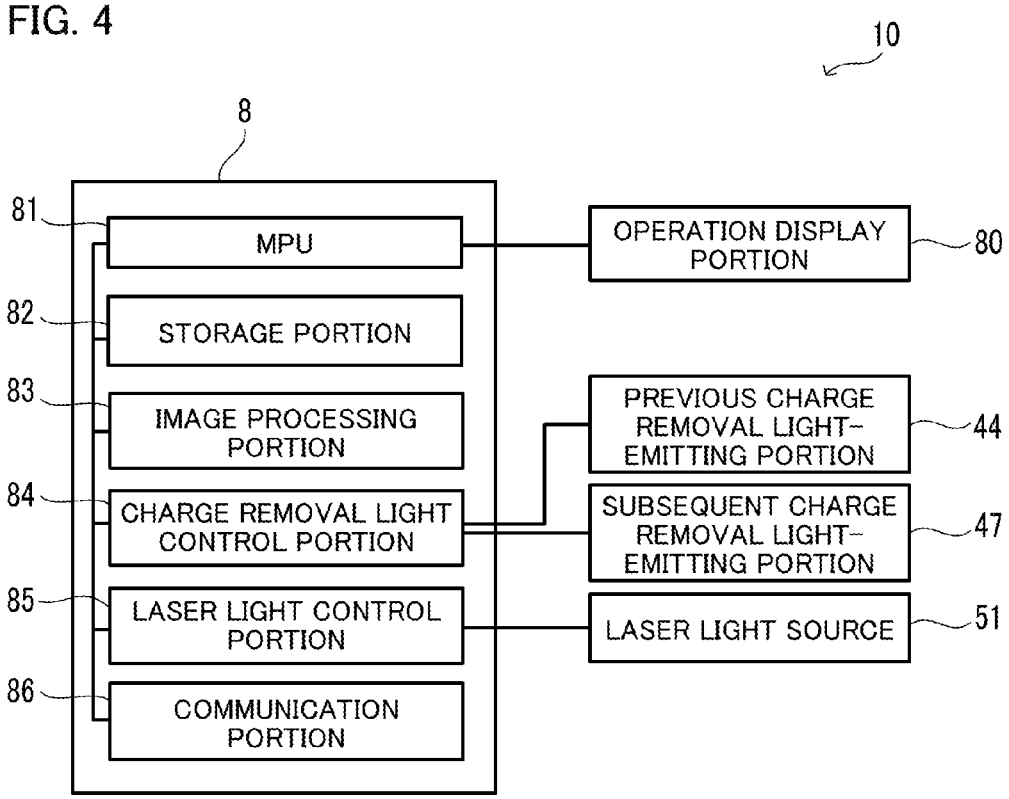
FIG. 4 is a block diagram of control-related devices of the image forming apparatus according to the first embodiment of the present disclosure.

For example, as shown in FIG. 4, the control portion 8 includes a micro processor unit (MPU) 81, a storage portion 82, an image processing portion 83, a charge removal light control portion 84, a laser light control portion 85, and a communication portion 86, etc.

The MPU 81 is a processor which executes various calculation processes. The storage portion 82 is a non-transitory computer-readable non-volatile information storage medium in which programs for causing the MPU 81 to execute various processes and other information are stored in advance. Furthermore, the storage portion 82 is also a non-transitory computer-readable information storage medium into which various kinds of information can be written by the MPU 81.

The control portion 8 centrally controls the image forming apparatus 10 by the MPU 81 executing various programs stored in the storage portion 82 in advance.

The image processing portion 83 receives an image formation job through the communication portion 86 from a host apparatus which is not shown, and executes an image process. For example, the image processing portion 83 generates image data on the basis of the image formation job obtained from the host apparatus.

The laser light control portion 85 controls an output light amount of the laser light source 51 in accordance with the density of each pixel indicated by the image data obtained from the image processing portion 83. Thus, the electrostatic latent image corresponding to the image data is formed on the effective outer circumferential surface 410 of the photosensitive member 41.

The communication portion 86 executes wired or wireless communication with the host apparatus such as a personal computer or a mobile terminal. For example, the communication portion 86 receives the image formation job from the host apparatus.

The charge removal light control portion 84 controls a light emission state of each of the previous charge removal light-emitting portion 44 and the subsequent charge removal light-emitting portion 47. Specifically, the charge removal light control portion 84 turns off the previous charge removal light-emitting portion 44 and the subsequent charge removal light-emitting portion 47 while at least the charging portion 42 and the developing portion 43 stop. In addition, the charge removal light control portion 84 turns on the previous charge removal light-emitting portion 44 and the subsequent charge removal light-emitting portion 47 during operation of the charging portion 42 and the developing portion 43.

The charge removal light control portion 84 keeps the subsequent charge removal light-emitting portion 47 in a lighting state during operation of the charging portion 42 and the developing portion 43. Control of the previous charge removal light-emitting portion 44 by the charge removal light control portion 84 will be described in detail later.

Meanwhile, in the two-component developing method, a problem of carrier shift can arise. The carrier shift is a phenomenon that the carrier 92 in the magnetic brush 900 shifts to the outer circumferential surface of the photosensitive member 41. When the charged potential of the photosensitive member 41 or the charged state of the carrier 92 is adjusted, the carrier shift and a development failure have a trade-off relationship.

The development failure is, for example, development fog, rear end accumulation, or the like. The development fog is a phenomenon that the toner 91 adheres to a region of the effective outer circumferential surface 410 of the photosensitive member 41 on which development should not be performed. The rear end accumulation is a phenomenon that the toner 91 adhering to the photosensitive member 41 is attracted by an electric force of the carrier 92 on the developing roller 430 to accumulate at the downstream side in the rotation direction of the photosensitive member 41.

Therefore, it is difficult to improve the problem of the carrier shift while occurrence of the development failure is avoided, by adjusting the charged amount of the photosensitive member 41 or the charged state of the carrier 92.

Due to limitations on a space within the developing roller 430, limitations on cost, and the like, it is difficult to increase a force holding the carrier 92 on the developing roller 430 by increasing the magnetic force of the magnet 431 in the developing portion 43.

On the other hand, if the image forming apparatus 10 having a configuration described below is adopted, in the case where development is performed by the two-component developing method, the problem of the carrier shift can be improved while occurrence of the development failure is avoided.

[Pre-Transfer Charge Removing Portion]

In the present embodiment, each previous charge removal light-emitting portion 44 and the charge removal light control portion 84, which controls a lighting state of each previous charge removal light-emitting portion 44, are an example of a pre-transfer charge removing portion which applies the charge removal light to the first charge removal target region 413 of the effective outer circumferential surface 410 of the photosensitive member 41.

The first charge removal target region 413 in the present embodiment includes a portion of the magnetic brush contact region 411 and a region between the magnetic brush contact region 411 and the transfer position 412. In addition, the previous charge removal light-emitting portion 44 emits the charge removal light toward the magnetic brush contact region 411 from a position at the downstream side in the rotation direction of the photosensitive member 41 with respect to the position of the developing portion 43.

In the present embodiment, a part of the charge removal light from the previous charge removal light-emitting portion 44 is applied to the magnetic brush contact region 411. In this case, the charge removal light is applied mainly to a portion of the magnetic brush contact region 411 at the downstream side in the rotation direction of the photosensitive member 41, so that travelling of the charge removal light toward the upstream side is blocked by the magnetic brush 900.

In general, the carrier shift is likely to occur at a downstream side portion of the magnetic brush contact region 411. At such a downstream side portion of the magnetic brush contact region 411, if the charged amount of the photosensitive member 41 decreases due to application of the charge removal light, occurrence of the carrier shift is suppressed.

A region where the carrier shift is particularly likely to occur is a region from a position at which a magnetic force component in a magnetic force peak direction D0 is 80% of a peak magnetic force in a magnetic field generated toward the photosensitive member 41 by the magnet 431 of the developing portion 43, to the end of the magnetic brush contact region 411 at the transfer position 412 side. The magnetic force peak direction D0 is a direction in which a magnetic force becomes a peak in the magnetic field generated toward the photosensitive member 41 by the magnet 431.

In the example shown in FIG. 2, a main pole 4311 of the magnet 431 of the developing portion 43 which main pole 4311 is closest to the photosensitive member 41 generates the magnetic field toward the photosensitive member 41. The magnetic field generated by the main pole 4311 forms the magnetic brush 900 standing toward the photosensitive member 41.

Therefore, the position at which the magnetic force component in the magnetic force peak direction D0 is 80% of the peak magnetic force in the magnetic field generated toward the photosensitive member 41 by the main pole 4311 of the magnet 431 is desirably included in the first charge removal target region 413 which is a region to which the charge removal light is applied.

Due to the light-blocking action of the magnetic brush 900, influence of the charge removal light on an upstream side portion of the magnetic brush contact region 411, that is, on a development region in which the toner 91 mainly shifts to the photosensitive member 41, is small. Thus, a development failure due to a decrease in the charged amount of the development region by the charge removal light is unlikely to occur.

The development failure due to the charge removal light from the previous charge removal light-emitting portion 44 is, for example, a phenomenon that a part of the toner image is missing due to a decrease in the force holding the toner 91 on the effective outer circumferential surface 410 of the photosensitive member 41. The effective outer circumferential surface 410 of the photosensitive member 41 holds the toner 91 by an electric attraction force.

Meanwhile, it is desired to allow the development failure due to the charge removal light to be avoided more assuredly. For example, even when the previous charge removal light-emitting portion 44 having relatively high output is selected, or when the light blocking action is varied due to variation in a formation state of the magnetic brush 900, it is desired to allow the development failure due to the charge removal light to be avoided.

Thus, the previous charge removal light-emitting portion 44 and the charge removal light control portion 84 in the present embodiment change the light amount of the previous charge removal light-emitting portion 44 in accordance with the density of the toner image on the first charge removal target region 413 of the photosensitive member 41. As described later, the charge removal light control portion 84 makes the light amount of the previous charge removal light-emitting portion 44 smaller when the density of the toner image on the first charge removal target region 413 is high than when the density of the toner image is low.

As shown in FIG. 3, the previous charge removal light-emitting portion 44 in the present embodiment is formed over the entire range of the first charge removal target region 413 in the first direction D1. Thus, the previous charge removal light-emitting portion 44 is able to apply the charge removal light to the entire range of the first charge removal target region 413 in the first direction D1.

[Previous Charge Removal Light Control]

Figure 5:
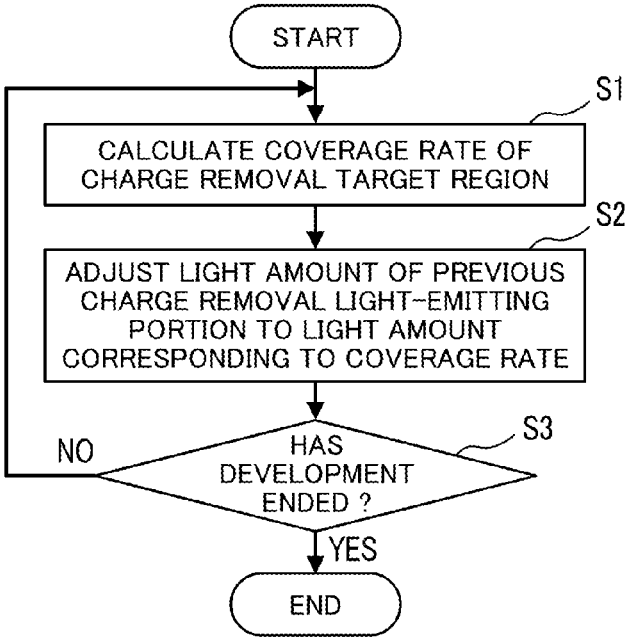
FIG. 5 is a flowchart showing an example of a procedure of previous charge removal light control in the image forming apparatus according to the first embodiment of the present disclosure.
Figure 6:
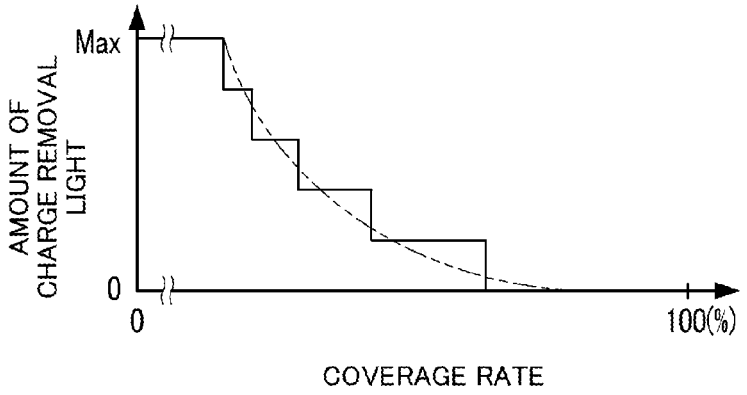
FIG. 6 is a graph representing a relationship between a coverage rate of a first charge removal target region and an amount of charge removal light in the image forming apparatus according to the first embodiment of the present disclosure.

Next, an example of previous charge removal light control will be described with reference to FIGS. 5 and 6. The previous charge removal light control is control of the light emission state of the previous charge removal light-emitting portion 44 by the charge removal light control portion 84. FIG. 5 is a flowchart showing an example of a procedure of the previous charge removal light control. FIG. 6 is a graph representing a relationship between a coverage rate of the first charge removal target region 413 and the amount of the charge removal light.

In the following description, S1, S2, . . . represent identification characters for respective steps executed by the charge removal light control portion 84. The previous charge removal light control is executed as a part of an image forming process which is started when the communication portion 86 receives the image formation job from the host apparatus.

<Step S1>

In the previous charge removal light control, first, the charge removal light control portion 84 calculates a coverage rate of the first charge removal target region 413. The charge removal light control portion 84 calculates the coverage rate by counting pixels having a predetermined density or more in the image data obtained from the image processing portion 83. The coverage rate of the first charge removal target region 413 corresponds to the density of the toner image on the first charge removal target region 413.

In the present embodiment, the charge removal light control portion 84 calculates the coverage rate for the entire range of the first charge removal target region 413 in the first direction D1. As described above, the first direction D1 corresponds to the width direction of the photosensitive member 41.

<Step S2>

Subsequently, the charge removal light control portion 84 adjusts the light amount of the previous charge removal light-emitting portion 44 to a light amount corresponding to the coverage rate of the first charge removal target region 413. The charge removal light control portion 84 makes the light amount of the previous charge removal light-emitting portion 44 smaller when the coverage rate of the first charge removal target region 413 is high than when the coverage rate is low. If the adjusted light amount is not zero, the charge removal light from the previous charge removal light-emitting portion 44 is applied in the adjusted light amount to the entire range of the first charge removal target region 413.

In the example shown in FIG. 6, the charge removal light control portion 84 decreases stepwise the light amount of the previous charge removal light-emitting portion 44 from a maximum light amount as the coverage rate of the first charge removal target region 413 increases. As in the graph of an alternate long and two short dashes line shown in FIG. 6, the charge removal light control portion 84 may continuously change the light amount of the previous charge removal light-emitting portion 44 in accordance with the coverage rate of the first charge removal target region 413.

In the example shown in FIG. 6, when the coverage rate of the first charge removal target region 413 exceeds a predetermined upper limit, the charge removal light control portion 84 turns off the previous charge removal light-emitting portion 44. For example, the charge removal light control portion 84 may adjust the light amount of the previous charge removal light-emitting portion 44 through well-known PWM control.

<Step S3>

After step S2 is executed, the charge removal light control portion 84 determines whether a development process corresponding to the image formation job has ended. The charge removal light control portion 84 repeats the processes in steps S1 and S2 until the development process ends.

As described above, the charge removal light control portion 84 in the present embodiment changes the amount of the light applied to the first charge removal target region 413 by the previous charge removal light-emitting portion 44, in accordance with the density of the toner image (the coverage rate) on the entire range of the first charge removal target region 413 in the first direction D1.

In general, the carrier shift is likely to occur in a region of the effective outer circumferential surface 410 of the photosensitive member 41 in which region the proportion of a no-image area in which the toner image has not been formed is high. On the other hand, the development failure such as missing of a part of the toner image is likely to occur in a region in which the proportion of the toner image is high.

In the present embodiment, when the first charge removal target region 413 becomes the no-image area or becomes close to the no-image area, the charge removal light from the previous charge removal light-emitting portion 44 is applied in a larger light amount to the first charge removal target region 413.

In other words, when an effect of suppressing the carrier shift is high and the development failure is less likely to occur, the charge removal light from the previous charge removal light-emitting portion 44 is applied in a larger light amount to the first charge removal target region 413.

When the density of the toner image on the first charge removal target region 413 is high, the charge removal light from the previous charge removal light-emitting portion 44 is applied in a smaller light amount to the first charge removal target region 413, or is not applied to the first charge removal target region 413.

In other words, when the effect of suppressing the carrier shift is low and the development failure is likely to occur, the charge removal light from the previous charge removal light-emitting portion 44 is applied in a smaller light amount to the first charge removal target region 413, or is not applied to the first charge removal target region 413. As a result of the above, it is possible to allow the development failure due to the charge removal light to be avoided more assuredly.

[Second Embodiment]

Next, an image forming apparatus 10A according to a second embodiment will be described with reference to FIGS. 7 and 8. The image forming apparatus 10A has a configuration in which each previous charge removal light-emitting portion 44 of the image forming apparatus 10 is replaced with a previous charge removal light-emitting portion 44A.

Figure 7:
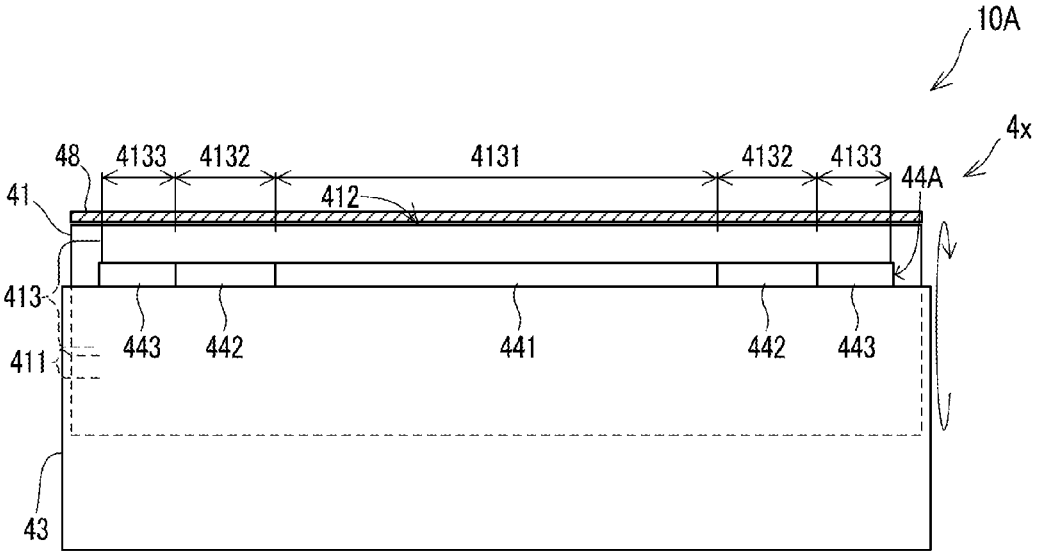
FIG. 7 is a configuration diagram of a previous charge removal light-emitting portion and a peripheral region thereof in an image forming apparatus according to a second embodiment of the present disclosure, as seen along a second direction.

FIG. 7 is a configuration diagram of the previous charge removal light-emitting portion 44A and a peripheral region thereof in the image forming apparatus 10A, as seen along the second direction D2. FIG. 8 is a block diagram of control-related devices of the image forming apparatus 10A. In FIGS. 7 and 8, the same components as those shown in FIGS. 1 to 5 are designated by the same reference characters. Hereinafter, the difference of the image forming apparatus 10A from the image forming apparatus 10 will be described.

Similarly to the previous charge removal light-emitting portion 44, the previous charge removal light-emitting portion 44A of the image forming apparatus 10A is also a light-emitting portion capable of applying the charge removal light to the first charge removal target region 413 including a part of the magnetic brush contact region 411.

The previous charge removal light-emitting portion 44A includes unit previous charge removal light-emitting portions 441, 442, and 443 capable of applying the charge removal light to partial target regions 4131, 4132, and 4133 each of which forms a part of the first charge removal target region 413 in the first direction D1. In the present embodiment, the previous charge removal light-emitting portion 44A includes a plurality of the unit previous charge removal light-emitting portions 441, 442, and 443 capable of applying the charge removal light to a plurality of the partial target regions 4131, 4132, and 4133, respectively.

Each of the unit previous charge removal light-emitting portions 441, 442, and 443 is, for example, an LED array or the like formed so as to extend along the first direction D1. The charge removal light control portion 84 is able to individually control light emission states of the respective unit previous charge removal light-emitting portions 441, 442, and 443.

In the example shown in FIG. 7, the first charge removal target region 413 includes a single first partial target region 4131, a pair of second partial target regions 4132, and a pair of third partial target regions 4133. The previous charge removal light-emitting portion 44A includes a first unit previous charge removal light-emitting portion 441 capable of applying the charge removal light to the single first partial target region 4131, a pair of second unit previous charge removal light-emitting portions 442 capable of applying the charge removal light to the pair of second partial target regions 4132, and a pair of third unit previous charge removal light-emitting portions 443 capable of applying the charge removal light to the pair of third partial target regions 4133.

The first partial target region 4131 is a region including a center portion of the first charge removal target region 413 in the first direction D1. The pair of second partial target regions 4132 are regions adjacent to both sides of the first partial target region 4131. The pair of third partial target regions 4133 are regions extending from both ends of the first charge removal target region 413 to the second partial target regions 4132.

For example, each of the second partial target regions 4132 and the third partial target regions 4133 is a region which can be the no-image area depending on each of a plurality of types of regular sizes of recording sheets 9.

The charge removal light control portion 84 of the image forming apparatus 10A executes the previous charge removal light control shown in FIG. 5 on the corresponding unit previous charge removal light-emitting portion 441, 442, or 443 for each of the respective partial target regions 4131, 4132, and 4133. That is, the charge removal light control portion 84 changes the light amount of the first unit previous charge removal light-emitting portion 441 in accordance with the coverage rate of the first partial target region 4131. Similarly, the charge removal light control portion 84 changes the light amounts of the pair of second unit previous charge removal light-emitting portions 442 in accordance with the coverage rates of the pair of second partial target regions 4132. Similarly, the charge removal light control portion 84 changes the light amounts of the third unit previous charge removal light-emitting portions 443 in accordance with the coverage rates of the third partial target regions 4133.

Also in the present embodiment, the entire previous charge removal light-emitting portion 44A is able to apply the charge removal light to the entire range of the first charge removal target region 413 in the first direction D1. Therefore, also in the present embodiment, the charge removal light control portion 84 changes the amount of the charge removal light applied to the entire range of the first charge removal target region 413 in the first direction D1 in accordance with the density of the toner image (the coverage rate) on the entire range of the first charge removal target region 413 in the first direction D1.

When the image forming apparatus 10A is adopted, the same advantageous effects as those when the image forming apparatus 10 is adopted are obtained. In addition, with the image forming apparatus 10A, the light amount and the range in which the charge removal light from the previous charge removal light-emitting portion 44A is applied to the first charge removal target region 413 are more finely controlled. Therefore, it is possible to allow the development failure due to the charge removal light to be avoided more assuredly.

[Third Embodiment]

Next, an image forming apparatus 10B according to a third embodiment will be described with reference to FIG. 9. The image forming apparatus 10B has a configuration in which each developing portion 43 of the image forming apparatus 10 is replaced with a developing portion 43B.

Figure 9:
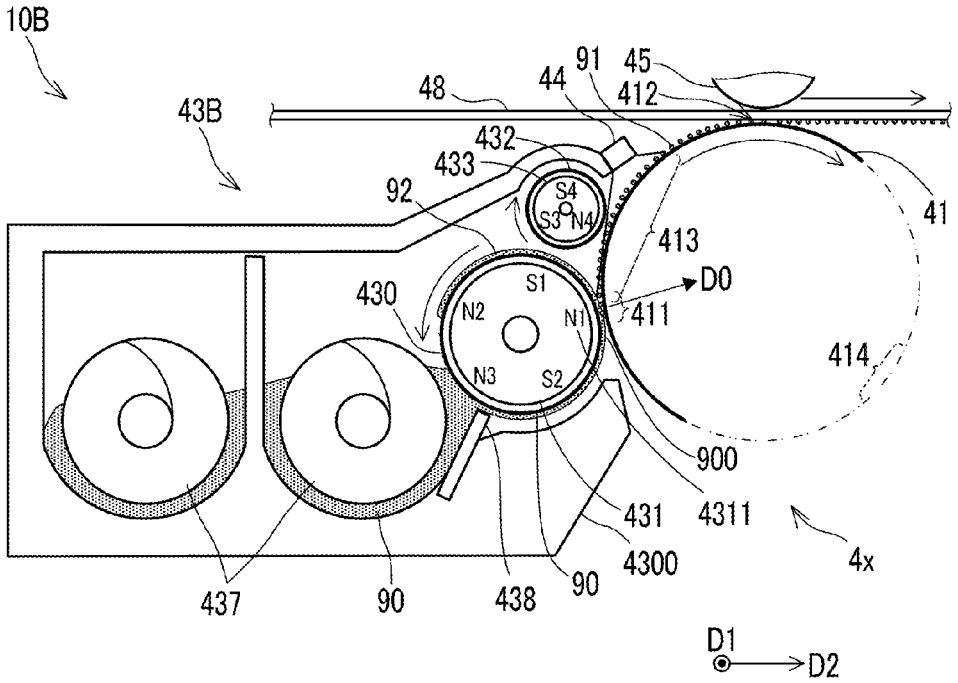
FIG. 9 is a configuration diagram of a previous charge removal light-emitting portion and a peripheral region thereof in an image forming apparatus according to a third embodiment of the present disclosure, as seen along a first direction.

FIG. 9 is a configuration diagram of the previous charge removal light-emitting portion 44 and a peripheral region thereof in the image forming apparatus 10B, as seen along the second direction D2. In FIG. 9, the same components as those shown in FIGS. 1 to 5 are designated by the same reference characters. Hereinafter, the difference of the image forming apparatus 10B from the image forming apparatus 10 will be described.

The developing portion 43B of the image forming apparatus 10B has a configuration in which a collecting roller 432 and a magnet 433 for carrier collection are added to the developing portion 43 of the image forming apparatus 10. The magnet 433 is housed in the collecting roller 432. The collecting roller 432 and the magnet 433 form a magnet roller for collecting the carrier 92 that has shifted to the photosensitive member 41, into the developer tank 4300.

The collecting roller 432 rotates so as to be opposed to the photosensitive member 41 in a non-contact state at a position at the downstream side in the rotation direction of the photosensitive member 41 with respect to the position of the developing roller 430. The collecting roller 432 is a rotator which rotates so as to be opposed to a portion of the effective outer circumferential surface 410 of the photosensitive member 41 between the magnetic brush contact region 411 and the transfer position 412. The collecting roller 432 is an example of a collecting rotator.

A bias which produces a potential difference between the collecting roller 432 and the photosensitive member 41 which potential difference has the same polarity as the charged polarity of the toner 91 is applied to the collecting roller 432. Due to the bias applied to the collecting roller 432, a force attracting the poorly charged toner 91 and the carrier 92 that has shifted to the photosensitive member 41, to the collecting roller 432, acts on the toner 91 and the carrier 92. In addition, the magnet 433 in the collecting roller 432 generates a magnetic field attracting the carrier 92 at the photosensitive member 41 side.

Therefore, the collecting roller 432 attracts and collects the poorly charged toner 91 and the carrier 92 that has shifted to the photosensitive member 41.

In the image forming apparatus 10B, the previous charge removal light-emitting portion 44 is disposed at a position at the downstream side in the rotation direction of the photosensitive member 41 with respect to the position of the collecting roller 432. The previous charge removal light-emitting portion 44 emits the charge removal light toward the first charge removal target region 413 including the magnetic brush contact region 411, from the position at the downstream side in the rotation direction of the photosensitive member 41 with respect to the position of the collecting roller 432. In this case, the charge removal light from the previous charge removal light-emitting portion 44 reaches the magnetic brush contact region 411 through a gap between the collecting roller 432 and the photosensitive member 41.

When the image forming apparatus 10B is adopted, the carrier shift is suppressed by application of the charge removal light to the magnetic brush contact region 411, similarly as in the case where the image forming apparatus 10 is adopted. In addition, a slight amount of the carrier 92 that has still shifted to the photosensitive member 41 is also collected into the developer tank 4300 by the collecting roller 432.

[Fourth Embodiment]

Next, the difference of an image forming apparatus 10C according to a fourth embodiment from the image forming apparatuses according to the first to third embodiments will be described with reference to FIG. 10.

Each previous charge removal light-emitting portion 44 and the charge removal light control portion 84 in the present embodiment apply the charge removal light selectively to a region in which the density of the toner image is less than a predetermined level, of the first charge removal target region 413 of the effective outer circumferential surface 410 of the photosensitive member 41.

Also in the present embodiment, the previous charge removal light-emitting portion 44 is formed over the entire range of the first charge removal target region 413 in the first direction D1 (see FIG. 3). Thus, the previous charge removal light-emitting portion 44 is able to apply the charge removal light to the entire range of the first charge removal target region 413 in the first direction D1. The previous charge removal light-emitting portion 44 in the present embodiment is an example of a first previous charge removal light-emitting portion.

[Previous Charge Removal Light Control]

Figure 10:
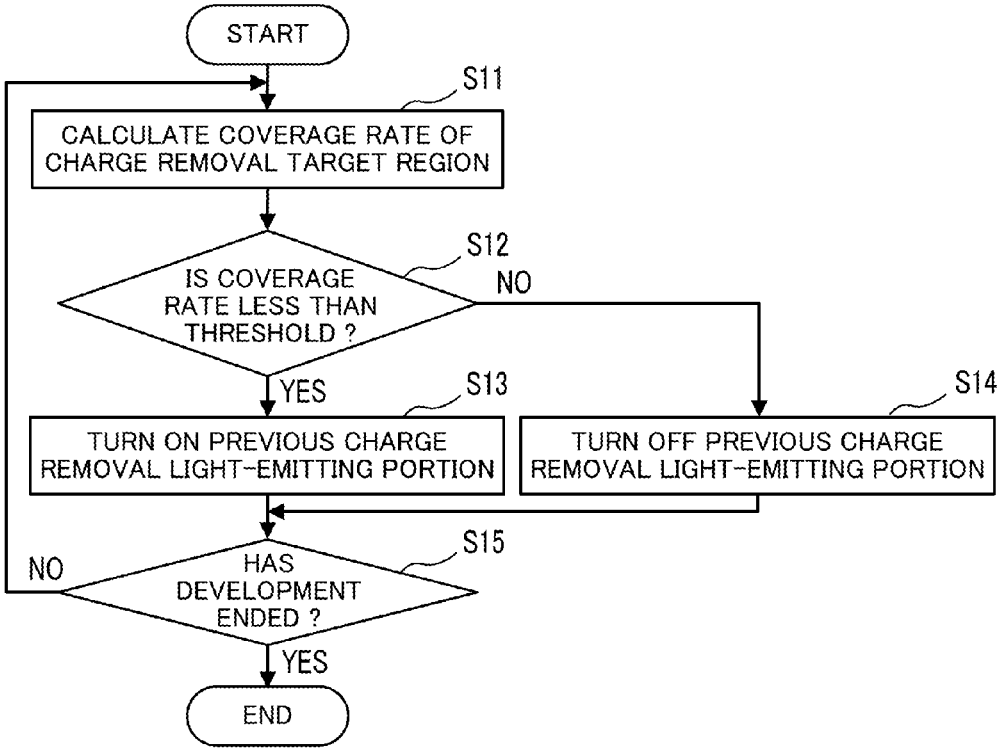
FIG. 10 is a flowchart showing an example of a procedure of previous charge removal light control in an image forming apparatus according to a fourth embodiment of the present disclosure.

FIG. 10 is a flowchart showing an example of a procedure of the previous charge removal light control in the present embodiment. The previous charge removal light control is control of a light emission state of the previous charge removal light-emitting portion 44 by the charge removal light control portion 84.

In the following description, S11, S12, . . . represent identification characters for respective steps executed by the charge removal light control portion 84. The previous charge removal light control is executed as a part of an image forming process which is started when the communication portion 86 receives the image formation job from the host apparatus.

<Step S11>

In the previous charge removal light control, first, the charge removal light control portion 84 calculates a coverage rate of the first charge removal target region 413. The charge removal light control portion 84 calculates the coverage rate by counting pixels having a predetermined density or more in the image data obtained from the image processing portion 83. The coverage rate of the first charge removal target region 413 corresponds to the density of the toner image on the first charge removal target region 413.

In the present embodiment, the charge removal light control portion 84 calculates the coverage rate for the entire range of the first charge removal target region 413 in the first direction D1. As described above, the first direction D1 corresponds to the width direction of the photosensitive member 41.

<Step S12>

Subsequently, the charge removal light control portion 84 determines whether the coverage rate of the first charge removal target region 413 is less than a preset threshold.

For example, the threshold may be a minimum value greater than zero. In this case, step S12 is a step of determining whether the first charge removal target region 413 is the no-image area in which the toner image is not present. In general, in the case where image formation is successively performed on a plurality of recording sheets 9, at timing when the first charge removal target region 413 corresponds to a region between successive two recording sheets 9, the first charge removal target region 413 becomes the no-image area.

Depending on the contents of the image data, at timing during a period when image formation is performed on a single recording sheet 9, the first charge removal target region 413 may become the no-image area.

The threshold may be a value greater than the minimum value greater than zero.

<Step S13>

If the coverage rate of the first charge removal target region 413 is less than the threshold, the charge removal light control portion 84 turns on the previous charge removal light-emitting portion 44. Accordingly, the charge removal light from the previous charge removal light-emitting portion 44 is applied to the entire range of the first charge removal target region 413.

<Step S14>

On the other hand, if the coverage rate of the first charge removal target region 413 is not less than the threshold, the charge removal light control portion 84 turns off the previous charge removal light-emitting portion 44. In this case, the charge removal light is not applied to the first charge removal target region 413.

<Step S15>

After step S13 or S14 is executed, the charge removal light control portion 84 determines whether a development process corresponding to the image formation job has ended. The charge removal light control portion 84 repeats the processes in steps S11 to S14 until the development process ends.

As described above, the charge removal light control portion 84 in the present embodiment turns on the previous charge removal light-emitting portion 44 (S13) if the density of the toner image (the coverage rate) on the entire range of the first charge removal target region 413 in the first direction D1 is less than a predetermined level, and turns on the previous charge removal light-emitting portion 44 (S14) in the other case.

In general, the carrier shift is likely to occur in a region of the effective outer circumferential surface 410 of the photosensitive member 41 in which the proportion of a no-image area in which region the toner image has not been formed is high. On the other hand, the development failure such as missing of a part of the toner image is likely to occur in a region in which the proportion of the toner image is high. In the present embodiment, when the first charge removal target region 413 becomes the no-image area or becomes close to the no-image area, the charge removal light from the previous charge removal light-emitting portion 44 is selectively applied to the first charge removal target region 413.

In other words, only when an effect of suppressing the carrier shift is high and the development failure is less likely to occur, the charge removal light from the previous charge removal light-emitting portion 44 is applied to the first charge removal target region 413. As a result, it is possible to allow the development failure due to the charge removal light to be avoided more assuredly.

[Fifth Embodiment]

Next, an image forming apparatus according to a fifth embodiment will be described. The image forming apparatus according to the fifth embodiment is an apparatus obtained by applying control of the image forming apparatus 10C according to the fourth embodiment to the image forming apparatus 10A according to the second embodiment. Hereinafter, the difference of the image forming apparatus according to the present embodiment from the image forming apparatuses according to the first to fourth embodiments will be described.

Figure 8:
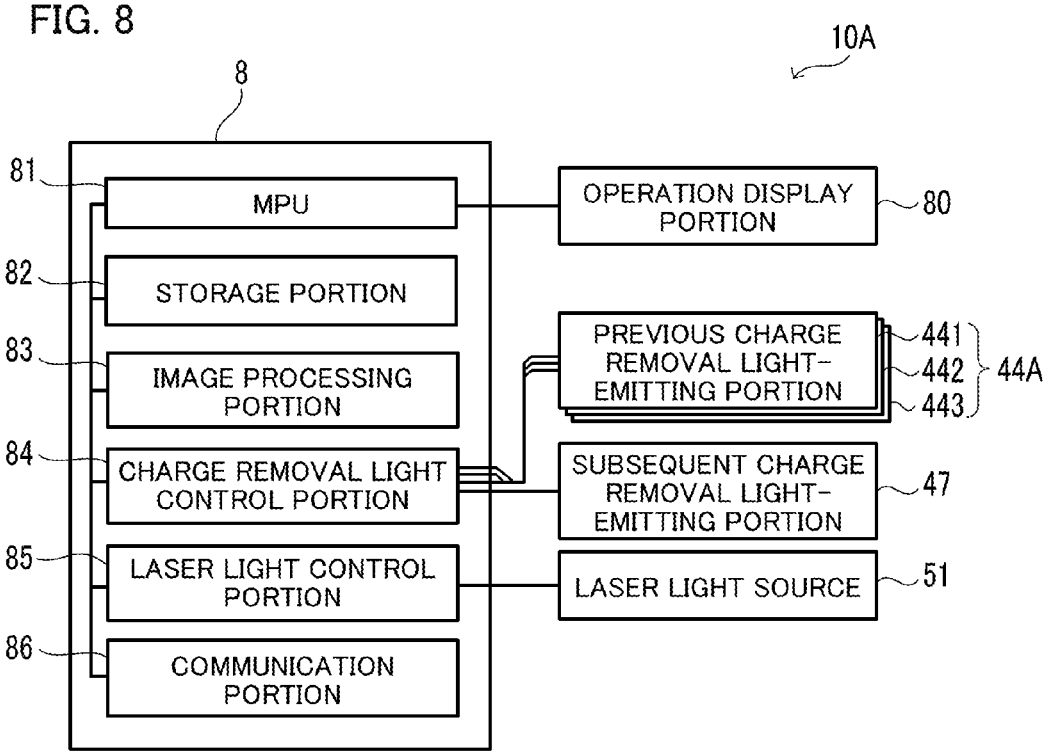
FIG. 8 is a block diagram of control-related devices of the image forming apparatus according to the second embodiment of the present disclosure.

The image forming apparatus according to the present embodiment has the configuration shown in FIGS. 7 and 8. The details of the configuration shown in FIGS. 7 and 8 are as described above. In the present embodiment, the unit previous charge removal light-emitting portions 441, 442, and 443 are an example of a second previous charge removal light-emitting portion.

In the image forming apparatus according to the present embodiment, the charge removal light control portion 84 executes the previous charge removal light control shown in FIG. 10 for each of the partial target regions 4131, 4132, and 4133. That is, the charge removal light control portion 84 controls turning-on and turning-off of the first unit previous charge removal light-emitting portion 441 on the basis of whether the coverage rate of the first partial target region 4131 is less than the preset threshold. Similarly, the charge removal light control portion 84 controls turning-on and turning-off of the pair of second unit previous charge removal light-emitting portions 442 on the basis of whether the coverage rates of the pair of second partial target regions 4132 are less than the preset threshold. Similarly, the charge removal light control portion 84 controls turning-on and turning-off of the third unit previous charge removal light-emitting portions 443 on the basis of whether the coverage rates of the third partial target regions 4133 are less than the preset threshold.

Also in the present embodiment, the entire previous charge removal light-emitting portion 44A is able to apply the charge removal light to the entire range of the first charge removal target region 413 in the first direction D1. Therefore, also in the present embodiment, the charge removal light control portion 84 turns on the entire previous charge removal light-emitting portion 44A if the density of the toner image (the coverage rate) on the entire range of the first charge removal target region 413 in the first direction D1 is less than a predetermined level, and turns off the entire previous charge removal light-emitting portion 44A if not so.

When the present embodiment is adopted, the same advantageous effects as those when the image forming apparatus 10C is adopted are obtained. In addition, according to the present embodiment, the timing and the range in which the charge removal light from the previous charge removal light-emitting portion 44A is applied to the first charge removal target region 413 are more finely controlled. Therefore, it is possible to allow the development failure due to the charge removal light to be avoided more assuredly.

[Results of Evaluation Experiment]

Hereinafter, the results of an evaluation experiment in which the case where control of turning-on and turning-off of the previous charge removal light-emitting portion 44 or 44A is performed and the case where such control is not performed were compared to each other, will be described. The conditions of the evaluation experiment are as follows. In the evaluation experiment, image formation was performed successively on 30 recording sheets 9 for 1 minute. In the evaluation experiment, the peripheral speed of the developing roller 430 is 1.6 times of the peripheral speed of the photosensitive member 41. In the evaluation experiment, the interval between the outer circumferential surface of the developing roller 430 and the effective outer circumferential surface 410 of the photosensitive member 41 is 0.3 nm. In the evaluation experiment, the potential of the no-image area of the effective outer circumferential surface 410 of the photosensitive member 41 is +450 V, and the potential of the electrostatic latent image on the effective outer circumferential surface 410 is +100 V. In the evaluation experiment, the photosensitive member 41 is an organic photosensitive member. In the evaluation experiment, the frequency of the bias to the developing roller 430, a duty ratio, an inter-peak potential difference, and a midpoint potential are 4.7 kHz, 50%, 1250 V, and 350 V, respectively. The toner 91 is positively chargeable.

In a first example of the evaluation experiment, the previous charge removal light-emitting portion 44 was turned on for the entire first charge removal target region 413 only when the entire range of the first charge removal target region 413 in the first direction D1 became the no-image area, that is, only when the first charge removal target region 413 corresponded to a region between successive two recording sheets 9.

In a second example of the evaluation experiment, the charge removal light was applied only to a pair of the no-image areas of the first charge removal target region 413 which were parts of ranges from both ends in the first direction D1. That is, only the third unit previous charge removal light-emitting portions 443 in the image forming apparatus 10A were turned on (see FIG. 7).

In a first comparative example of the evaluation experiment, the charge removal light was applied to the entire range of the first charge removal target region 413 in the first direction D1 constantly during a development process.

In a second comparative example of the evaluation experiment, the charge removal light was not applied to the first charge removal target region 413 during a development process.

In the first comparative example, the amount of the carrier 92 that shifted to the photosensitive member 41 was the smallest, but a phenomenon that a part of the toner image was missing occurred.

In the second comparative example, the phenomenon that a part of the toner image was missing did not occur, but the amount of the carrier 92 that shifted to the photosensitive member 41 was the largest.

In the first example, the phenomenon that a part of the toner image was missing did not occur, and the amount of the carrier 92 that shifted to the photosensitive member 41 was reduced to 32% of that in the second comparative example.

In the second example, the phenomenon that a part of the toner image was missing did not occur, and the amount of the carrier 92 that shifted to the photosensitive member 41 was reduced to 40% of that in the second comparative example.

From the evaluation experiment, it is understood that, when the fourth and fifth embodiments are adopted, the problem of the carrier shift can be improved while occurrence of the development failure is avoided.

[Sixth Embodiment]

Next, an image forming apparatus according to a sixth embodiment will be described. The image forming apparatus according to the sixth embodiment is an apparatus obtained by applying a collecting roller 432 shown in FIG. 11 to the image forming apparatus 10B according to the third embodiment. Hereinafter, the difference of the image forming apparatus according to the present embodiment from the image forming apparatuses according to the first to fifth embodiments will be described.

The image forming apparatus according to the present embodiment includes the developing portion 43B shown in FIG. 9. In addition, in the present embodiment, the collecting roller 432 of the developing portion 43B has a structure shown in FIG. 11. The configuration of the developing portion 43B is as described above. In the developing portion 43B, the developing roller 430 is an example of a developing rotator.

Meanwhile, a part of the charge removal light from the previous charge removal light-emitting portion 44 is reflected on the outer circumferential surface of the collecting roller 432, and the reflected light is applied to the charge removal target region 413 of the photosensitive member 41. When the reflectivity of the charge removal light on the outer circumferential surface of the collecting roller 432 is high, the ratio of the reflected light in the charge removal light applied to the charge removal target region 413 becomes high.

When the proportion of the reflected light in the charge removal light applied to the charge removal target region 413 is high, variations of the amount of the charge removal light applied to the charge removal target region 413 are increased due to a stain state of the outer circumferential surface of the collecting roller 432, variations of the position of the collecting roller 432, and the like. In this case, variations of the effect of suppressing the carrier shift increase.

Therefore, the outer circumferential surface of the collecting roller 432 in the present embodiment is formed in a black-based color. The black-based color is black, dark gray close to black, or the like.

Figure 11:
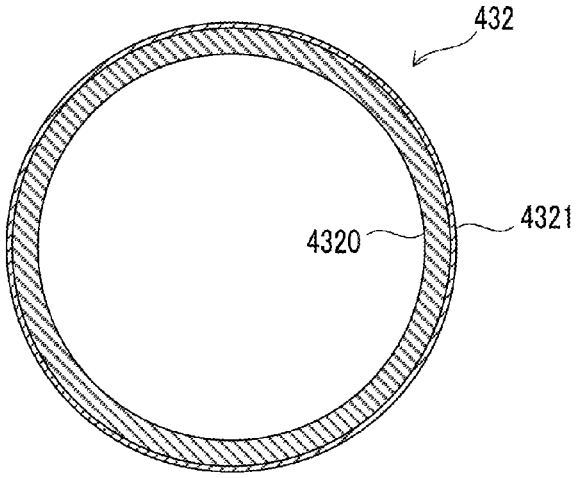
FIG. 11 is a cross-sectional view of a collecting roller included in a developing portion of an image forming apparatus according to a fifth embodiment of the present disclosure.

In the example shown in FIG. 11, the collecting roller 432 includes: a base portion 4320 which is a cylindrical metal member having a color which is not a black-based color; and an outer film 4321 which is formed on the outer circumferential surface of the base portion 4320 and has a black-based color. The outer film 4321 is a film formed by a treatment which decreases the reflectivity of the charge removal light.

For example, the outer film 4321 may be a coating material of a synthetic resin formed by a coating treatment such as dipping coating, spraying coating, or UV coating. The coating is an example of a treatment of coloring in a black-based color.

In addition, the outer film 4321 may be a film formed by performing a well-known coloring treatment, such as parkerizing, bonderizing, or alkali coloring, on the outer circumferential surface of the metallic base portion 4320. These coloring treatments are also examples of the treatment of coloring in a black-based color.

When the reflectivity of the charge removal light on the outer circumferential surface of the collecting roller 432 is low, the variations of the amount of the charge removal light applied to the charge removal target region 413 become small. As a result, the effect of suppressing the carrier shift is stably obtained.

The outer circumferential surface of the collecting roller 432 may be a surface subjected to a roughening treatment. Such a roughening treatment is an example of the treatment which decreases the reflectivity of the charge removal light. In addition, the outer circumferential surface of the collecting roller 432 may be a surface subjected to a roughening treatment and having a black-based color.

[Application Examples]

In the image forming apparatuses 10 and 10B described above, as the method of determining whether the density of the toner image on the first charge removal target region 413 is low, a method other than calculation of the coverage rate may be adopted.

Similarly, in the fourth and fifth embodiments, as the method of determining whether the density of the toner image on the first charge removal target region 413 is less than the predetermined level, a method other than comparison between the coverage rate and the threshold may be adopted.

For example, when image formation is performed successively on a plurality of recording sheets 9, the charge removal light control portion 84 determines whether the first charge removal target region 413 corresponds to a region between successive two recording sheets 9. In this case, when the first charge removal target region 413 corresponds to a region between successive two recording sheets 9, the charge removal light control portion 84 determines that the density of the toner image on the first charge removal target region 413 is low.

In the image forming apparatus 10A, the charge removal light control portion 84 may determine whether the density of the toner image is low in the pair of second partial target regions 4132 and the pair of third partial target regions 4133, in accordance with the size of a recording sheet 9 sent out to the conveyance path 30. For example, the charge removal light control portion 84 sets the output light amount of the previous charge removal light-emitting portion 44 at a reference light amount if it is determined that the density of the toner image is low, and sets the output light amount of the previous charge removal light-emitting portion 44 at a light amount smaller than the reference light amount, if not so.

The pre-transfer charge removing portion including the previous charge removal light-emitting portion 44 and the charge removal light control portion 84 may be applied to a monochrome image forming apparatus.

The image forming apparatus according to the present disclosure can be configured by freely combining the embodiments and application examples described above, or modifying or partially omitting the embodiments and the application examples as appropriate, within the scope of the invention recited in each claim.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a developing portion configured to carry a magnetic brush including toner and a carrier and bring the magnetic brush into contact with an effective outer circumferential surface of an outer circumferential surface of a rotating photosensitive member on which effective outer circumferential surface an electrostatic latent image can be formed, thereby to develop the electrostatic latent image into a toner image;

a previous charge removal light-emitting portion configured to apply charge removal light to a charge removal target region of the effective outer circumferential surface of the photosensitive member which charge removal target region includes a part of a magnetic brush contact region with which the magnetic brush is brought into contact and a region between the magnetic brush contact region and a transfer position of the toner image; and a charge removal light control portion configured to change a light amount of the previous charge removal light-emitting portion in accordance with a density of the toner image on the charge removal target region, wherein the charge removal light control portion makes the light amount of the previous charge removal light-emitting portion smaller when the density of the toner image on the charge removal target region is high than when the density of the toner image is low.

2. The image forming apparatus according to claim 1, wherein the previous charge removal light-emitting portion includes a plurality of unit previous charge removal light-emitting portions capable of applying the charge removal light to a plurality of partial regions each of which forms a part of the charge removal target region in a width direction of the photosensitive member, and in accordance with the density of the toner image on each of the partial regions of the charge removal target region, the charge removal light control portion adjusts a light amount of the corresponding unit previous charge removal light-emitting portion.

3. The image forming apparatus according to claim 1, wherein the charge removal target region of the effective outer circumferential surface of the photosensitive member includes a position at which a magnetic force component in a direction in which a magnetic force becomes a peak is 80% of a peak magnetic force in a magnetic field generated toward the photosensitive member by the developing portion.

4. The image forming apparatus according to claim 1, further comprising a charge removal light control portion configured to turn on the previous charge removal light-emitting portion if a density of the toner image on the charge removal target region is less than a predetermined level, and turn off the previous charge removal light-emitting portion if not so.

5. The image forming apparatus according to claim 4, wherein the previous charge removal light-emitting portion includes a first previous charge removal light-emitting portion capable of applying the charge removal light to an entire range of the charge removal target region in a width direction of the photosensitive member, and the charge removal light control portion turns on the first previous charge removal light-emitting portion if the density of the toner image on the entire range of the charge removal target region in the width direction of the photosensitive member is less than the predetermined level, and turns off the first previous charge removal light-emitting portion if not so.

6. The image forming apparatus according to claim 4, wherein the previous charge removal light-emitting portion includes a second previous charge removal light-emitting portion capable of applying the charge removal light to a partial target region which forms a part of the charge removal target region in the width direction of the photosensitive member, and the charge removal light control portion turns on the second previous charge removal light-emitting portion if the density of the toner image on the partial target region is less than the predetermined level, and turns off the second previous charge removal light-emitting portion if not so.

7. The image forming apparatus according to claim 4, wherein the charge removal target region of the effective outer circumferential surface of the photosensitive member includes a position at which a magnetic force component in a direction in which a magnetic force becomes a peak is 80% of a peak magnetic force in a magnetic field generated toward the photosensitive member by the developing portion.

8. An image forming apparatus comprising:

a developing rotator configured to rotate while carrying a magnetic brush including toner and a carrier and bring the magnetic brush into contact with an effective outer circumferential surface of an outer circumferential surface of a rotating photosensitive member on which effective outer circumferential surface an electrostatic latent image can be formed, thereby to develop the electrostatic latent image into a toner image;

a collecting rotator configured to rotate so as to be opposed to a portion of the effective outer circumferential surface of the photosensitive member between a transfer position of the toner image and a magnetic brush contact region with which the magnetic brush is brought into contact, to collect the carrier on the effective outer circumferential surface of the photosensitive member; and a previous charge removal light-emitting portion configured to apply charge removal light from a position at a downstream side in a rotation direction of the photosensitive member with respect to a position of the collecting rotator, to a charge removal target region of the effective outer circumferential surface of the photosensitive member which charge removal target region includes a part of the magnetic brush contact region and a region between the magnetic brush contact region and the transfer position, wherein the collecting rotator has an outer circumferential surface subjected to a treatment which decreases a reflectivity of the charge removal light.

9. The image forming apparatus according to claim 8, wherein the outer circumferential surface of the collecting rotator is subjected to a treatment of coloring in a black-based color.

10. The image forming apparatus according to claim 8, wherein the outer circumferential surface of the collecting rotator is subjected to a roughening treatment.

11. An image forming apparatus comprising:

a developing rotator configured to rotate while carrying a magnetic brush including toner and a carrier and bring the magnetic brush into contact with an effective outer circumferential surface of an outer circumferential surface of a rotating photosensitive member on which effective outer circumferential surface an electrostatic latent image can be formed, thereby to develop the electrostatic latent image into a toner image;

a collecting rotator having an outer circumferential surface formed in a black-based color, the collecting rotator being configured to rotate so as to be opposed to a portion of the effective outer circumferential surface of the photosensitive member between a transfer position of the toner image and a magnetic brush contact region with which the magnetic brush is brought into contact, to collect the carrier on the effective outer circumferential surface of the photosensitive member; and a previous charge removal light-emitting portion configured to apply charge removal light from a position at a downstream side in a rotation direction of the photosensitive member with respect to a position of the collecting rotator, to a charge removal target region of the effective outer circumferential surface of the photosensitive member which charge removal target region includes a part of the magnetic brush contact region and a region between the magnetic brush contact region and the transfer position.

12. The image forming apparatus according to claim 8, wherein the charge removal target region of the effective outer circumferential surface of the photosensitive member includes a position at which a magnetic force component in a direction in which a magnetic force becomes a peak is 80% of a peak magnetic force in a magnetic field generated toward the photosensitive member by a magnet in the developing rotator.

* * * * *